United States Patent [19]

Velasco et al.

[11] Patent Number: 4,813,541

[45] Date of Patent: Mar. 21, 1989

[54] TAMPERPROOF PACKAGE AND METHOD

[76] Inventors: Edward R. Velasco; Jo Ann Velasco, both of 2224 N. Camino Castile, Ste. 1019, Tucson, Ariz. 85715

[21] Appl. No.: 888,385

[22] Filed: Jul. 23, 1986

[51] Int. Cl.[4] ..... B65D 73/00

[52] U.S. Cl. ..... 206/459; 206/807; 215/365; 215/366; 220/214

[58] Field of Search ..... 206/489, 807; 215/365, 215/366; 220/214

[56] References Cited

U.S. PATENT DOCUMENTS

| | | | |
|---|---|---|---|
| 4,098,577 | 7/1978 | Halpern | 206/807 |
| 4,434,893 | 3/1984 | Barlow | 206/807 |
| 4,436,203 | 6/1984 | Reyner | 206/807 |
| 4,449,632 | 5/1984 | Marusiak, Jr. | 206/807 |
| 4,475,661 | 10/1984 | Griffin | 206/807 |
| 4,511,052 | 4/1985 | Klein et al. | 206/807 |
| 4,645,078 | 2/1987 | Reyner | 206/807 |

*Primary Examiner*—Joseph Man-Fu Moy
*Attorney, Agent, or Firm*—Sutton & Thomas Cahill

[57] ABSTRACT

A hermetic multi-barrier tamperproof package for encasing articles such as pharmaceutical products and the like, is disclosed. The package comprises: a first container typically being made of a substantially impervious plastic material into which the articles to be protected are placed prior to hermetically sealing the container so as to enclose the articles, and so as to further enclose normal atmosphere air within the container. A second container typically being made of a substantially impervious plastic material completely encloses the first container. The first and second containers are simultaneously separated from and connected to one another by attaching means comprising one or a number of discs having appertures in their centers, so as to allow a hermetic cavity defined between the first and second containers to extend continuously therebetween. A sensor comprising a select chemical or material is inserted within the cavity, and a select atmosphere such as a substantially evacuated atmosphere is simultaneously introduced within the cavity. The sensor and the select atmosphere co-operatively comprise a package integrity indicating sensor system where the sensor is simultaneously reactive to normal atmosphere air, and reversibly responsive to the presence or absence of the select atmosphere. A breach in package integrity will result in a loss of the select atmosphere and in exposure of the sensor to the normal atmosphere air enclosed within the first container and/or to the exterior atmosphere, whereby a chemical or physical response will occur that will produce an indication appealing to the sense of sight, touch, or smell at the point of puncture, or within the cavity that could evidence a package tampering. At least the first container incorporates sealingly associated cap and body portions being provided with recloseable closure means. Alternatively, the select atmosphere is omitted and the sensor is sandwiched between and in contact with the outer surface of the first container and the inner surface of the second container. One or more barriers can be completely enclosing the second container, and at least one cavity can exist between the first container and an outermost barrier.

8 Claims, 2 Drawing Sheets

TAMPERPROOF PACKAGE AND METHOD

BACKGROUND OF THE INVENTION

1. Field

The present invention relates in general to tamperproof packages, and more particularly, to tamperproof packages for encasing articles such as pharmaceutical, food, cosmetic, medical, chemical products and the like, where a change in a package integrity indicating sensor and/or package integrity could evidence a package tampering.

2. Prior Art

Heretofore, all attempts for providing a fail-safe tamperproof package have failed. A number of patents exist which use tamper-proof lids, bottle seals, or other encapsulating members in which an attempt to tamper with the contents will be visible to the consumer. Other existing patents use a sensor to signal loss of package integrity. Although known tamperproof packages do provide varying degrees of protection, they are not fail-safe, and can be circumvented by a determined tamperer by folowing the steps of: placing the entire package into an airtight chamber containing components and/or conditions identical to those existing or used during the original manufacturing process, and/or identical to the sensor used by the package to signal loss of package integrity, so that the changes which signal loss of package integrity will be nullified upon penetrating the package; removing the tamperproofing means; tampering with the contents; and then replacing the tamperproofing means, whereby the package will revert to its original state when returned to normal atmospheric conditions.

A prior art device is unknown to the inventors which provides a fail-safe hermetic multi-barrier tamperproof package for encasing articles such as pharmaceutical, food, cosmetic, medical, chemical products and the like, which incorporates a continuous hermetic cavity defined between at least two nested barrier walls encasing the articles to be protected, which hermetic cavity encloses a sensor comprising a select chemical or material and a select atmosphere such as a substantially evacuated atmosphere to co-operatively comprise a package integrity indicating sensor system, which sensor system is simultaneously reactive to the exterior atmosphere and/or to appropriately separated reagent means incorporated within the package, which reagent means can comprise a select atmosphere such as normal atmosphere air being enclosed within an innermost hermetic barrier such that upon breaching integrity of any package barrier, a chemical or physical response will occur that will produce an indication appealing to the sense of sight, touch, or smell at the point of puncture, or within the cavity that could evicence a package tampering, and; wherein at least one barrier comprises a contentholding hermetic container providing with recloseable closure means, which container is further provided with reagent means enclosed therein.

Examples of existing related patents include U.S. Pat. No. 4,515,679 incorporated herein by reference, disclosing a tamperproof wrap which provides a wrap discoloration, physical change, or deterioration at the point of entry upon wrap puncture. However, the wrap does not provide a hermetic container in a contentholding state being provided with recloseable closure means. A problem with the disclosed wrap is that consumer response toward packages that include liquid layers therein which may ooze upon opening, thereby damaging articles of clothing and the like, can be unfavorable to a certain degree even if the potential for such damage is merely an erroneous perception by the consumer. Another problem with this disclosure is that consumer acceptance of a wrap as disclosed therein can be limited, since the consumer tends to mistrust ingestible products which are package in a manner such that they are conceived to be easily contaminable by the chemicals contained therein, even if the chemicals are stated to be substantially harmless, unless he or she has special knowledge of the particular chemical used.

U.S. Pat. No. 4,098,577, incorporated herein by reference, discloses a method for detecting the loss of integrity of a sealed package, which method uses a sensor to signal loss of package integrity. This disclosure also does not provide a hermetic container in a contentholding state being provided with recloseable closure means. This disclosure has a further limitation in that the chemical comprising the sensor is in direct contact with the articles enclosed therein, thereby increasing the negative response by the consumer toward the contents.

The present invention provides a separate hermetic container adapted with recloseable closure means for the articles to be protected, thereby eliminating the negative responses by the consumer encountered by the referenced disclosures.

The primary object of the referenced patents can be circumvented by a determined and sophisticated tamperer by use of the previously described tampering process.

In recent times, the deaths of a number of victims of random illegal tampering with packages containing capsules of pain relief medicine have created great anxiety in the consuming public toward packaged products. The threat to the general public health has more recently become widespread by a wave of indiscriminate tampering with packages containing a variety of products including: cartons containing a popular gelatin desert, bottles containing baby foods, and bottles containing soft drinks.

Therefore, the need for a new class of packaging providing a fail-safe tamperproof package in which any puncture will produce a readily apparent indication that could evidence a package tampering remains urgent.

Therefore, it is an object of the present invention to provide a tamperproof package which is fail-safe.

It is another object of the present invention to provide a fail-safe tamperproof package for encasing articles subject to tampering where a change in a package integrity indicating sensor and/or package integrity could indicate a package tampering.

It is another object of the present invention to provide a fail-safe tamperproof package for encasing articles subject to tampering where breaching package integrity will provide an indication appealing to the sense of sight, touch, or smell at the point of puncture, or within the package that could evidence a package tampering.

It is still another object of the present invention to provide a fail-safe tamperproof package that can be easily constructed in multiple nested barriers which package includes a package integrity indicating sensor which is simultaneously reactive to the exterior atmosphere and/or to appropriatley separated reagent means provided within the package so that breaching integrity of any barrierwill result in a chemical or physical response that will produce an indication appealing to the sense of sight, touch, or smell at the point of puncture, or within the package that could evidence a package tampering.

It is another object of the present invention to provide a fail-safe tamperproof package that will provide prevention of oxidation or contamination of articles enclosed therein.

It is another object of the present invention to provide a fail-safe tamperproof package that will improve shipping, handling, and storing of articles enclosed therein.

It is still another object of the present inventin to provide a fail-safe tamperproof package that will improve shipping, handling, storing, applying, and dispensing of drugs and medications enclosed therein.

It is another object of the present invention to provide a fail-safe tamperproof package that will maintain purity of materials or substances enclosed therein.

It is another object of the present invention to provide a fail-safe tamperproof package that can control or regulate temperature of articles enclosed therein.

It is another object of the present invention to provide a fail-safe tamperproof package that can enhance freshness and/or shelf life of articles enclosed therein.

It is still another object of the present invention to provide a fail-safe tamperproof package where the articles to be protected from tampering are completely enclosed about their periphery by a hermetically-sealed sensor which sensor is sandwiched between inwardly and outwardly disposed reagent means so that placing the entire package into an airtight chamber incorporating components and/or conditions identical to those wxisting or used during the original manufacturing process, and/or identical to the sensor enclosed therein in an attempt to tamper with the contents will be futile, since the duplicate conditions into which the entire package is placed and/or the identical components contained in the airtight chamber into which the package is placed may circumvent the peripherally disposed sensor of the package, but will be reactive to the inwardly disposed reagent means incorporated within the package when mixing with one another upon breaching package integrity.

It is still another object of the present invention to provide a fail-safe tamperproof package in which the components comprising the construction of the packages are made of a non-toxic digestible material, which components include a plastic coating made of a novel material similar to styrofoam which is waterproof and substantially impermeable to stomach acid and to digestive enzymes, which material is digestible to bacteria present in the large intesting, and which material is formed and constructed to comprise articles such as capsules of medicine or other human ingestible products.

SUMMARY OF THE INVENTION

These and other objects of the present invention are achieved by a hermetic package for an article such as a pharmaceutical, food, cosmetic, medical, chemical product and the like, which package consists of: a first "complete" barrier comprising a hermetic container typically being made of a substantially impervious plastic material into which the article is placed prior to hermetically sealing the container by known methods of manufacture while under normal atmospheric conditions thereby enclosing the article and further enclosing normal atmosphere air within the container; a second barrier typically being made of a substantially impervious plastic material completely enclosing the first "complete" barrier, the first and second barriers being simultaneously separating from and connecting to one another by attaching means comprising one or more discs having apertures in their centers, which attaching means being disposed strategically between the first and second barriers so as to allow a hermetic cavity defined between the first and second barriers to extend continuously therebetween; a sensor comprising a select chemical or material being inserted within the cavity, and a select atmosphere such as a substantially evacuated atmosphere being simultaneously introduced within the cavity, the sensor and the select atmosphere co-operatively comprising a package integrity indicating sensor system where the sensor is simultaneously reactive to the exterior atmosphere and/or to appropriately separated reagent means incorporated within the package, which reagent means can comprise a select atmosphere such as normal atmosphere air being enclosed within the first container, and/or where the sensor is reversibly responsive to the presence or absence of the select atmosphere, such that upon breaching integrity of any package barrier, the select atmosphere will be lost and/or the sensor will be exposed to the normal atmosphere air being enclosed within the first container and/or to the exterior atmosphere, whereby a chemical or physical response will occur that will produce an indication appealing to the sense of sight, touch, or smell at the point of puncture, or within the cavity that could evidence a package tampering, which package includes at least one barrier comprising a content-holding hermetic container being provided with recloseable closure means, which container being further provided with reagent means being enclosed therein; or optionally, the select atmosphere is omitted and the sensor is sandwiched between and in contact with the first and second barriers; or alternatively, one or more barriers can be completely enclosing the second barrier, and at least one cavity can exist between the innermost and the outermost barriers.

In alternative embodiments of the package, the thickness, flexibility, configuration, translucence, color, and number of the barriers may vary.

Optionally, the sensor can be indicia means being impregnated on a carrier such as a mat or the like, or the sensor can be incorporated into an ink, which ink is printed or stamped on the carrier which is thereafter enclosed within the cavity when the cavity walls are transparent, translucent, or of a color such that the indicia means are visible from the exterior of the package, or similarly, the indicia means can be printed or stamped on a strip of paper, or; alternatively, the cavity walls can be transparent or translucent and the sensor can be coated, printed, or stamped on an inner surface of the cavity walls so as to be visible from the exterior of the package.

BRIEF DESCRIPTION OF THE DRAWINGS

Further objects of the present invention and novel features of the present invention will be apparent from the following description and claims taken in conjunction with the accompanying drawings in which:

FIG. 6 is a cross-sectional view of an alternative embodiment of the cylindrical container shown in FIG. 1, as shown, one or more barriers can be completely enclosing the second barrier of the invention, and at least one cavity can exist between the innermost and the outermost barriers.

DETAILED DESCRIPTION

Figure 1:
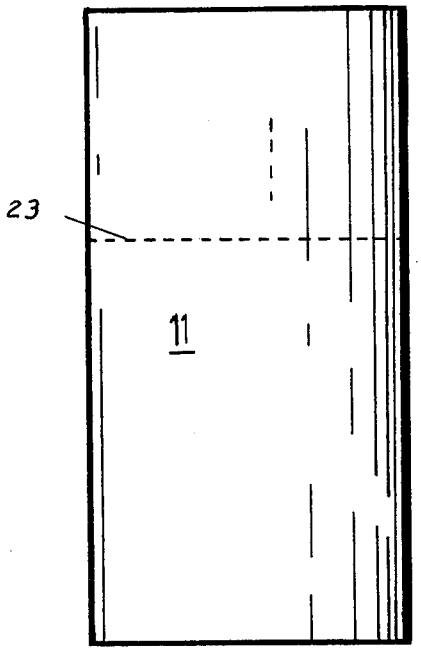
FIG. 1 shows a front view of a cylindrical container in which the invention may be incorporated.
Figure 2:
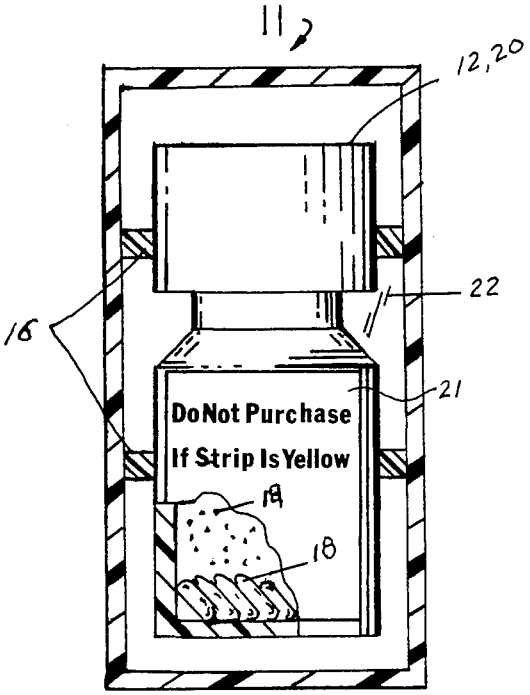
FIG. 2 is a cross-sectional view of the cylindrical container shown in FIG. 1, and illustrates the invention being incorporated therein.
Figure 3:
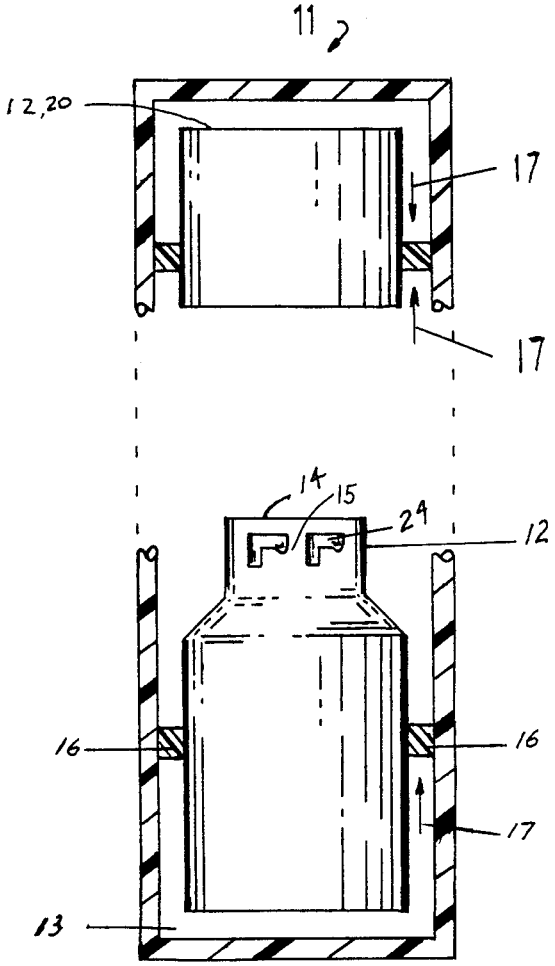
FIG. 3 is a cross-sectional view of the cylindrical container shown in FIG. 1, and illustrates the cap and body portions of the invention being separated from one another to reveal the opening of the inner container and the sealing means being bonded thereon.
Figure 4:
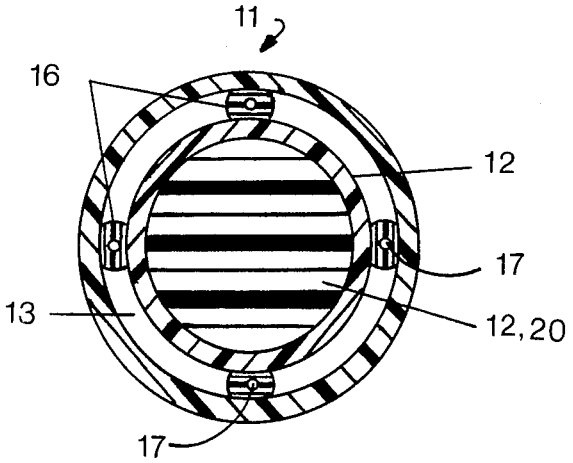
FIG. 4 is a bottom view of the cap portion of the cylindrical container shown in FIG. 1, and shows the attaching means being simultaneously separating and connecting the first and second barrier walls of the invention.

With reference to the drawings:

In FIG. 1 a first embodiment of the present invention is illusrated as a cylindrical multi-barrier hermetic package indicated generally by the reference character 11. FIGS. 2, 3, and 4 show the components of construction of the package illustrated in FIG. 1. The package 11 is typically made of a substantially impervious plastic material and may contain articles such as pharmaceutical, food, cosmetic, medical, chemical products 18 and the like. The package 11 consists of a first "complete" barrier 12 comprising a container 12 having an opening 15 through which the contents 18 are adapted to be filled in and poured out of the container 12. The articles 18 are placed into the container 12 prior to hermetically sealing the container 12 under normal atmospheric conditions so as to enclose the articles 18, and so as to further enclose normal atmosphere air 19 therein. Means for hermetic sealing are known and can be accomplished with a variety of substantially impervious materials such as aluminum foil 14, for example. A second barrier 11 completely encloses the first "complete" barrier 12. The first and second barriers 11 and 12 are simultaneously separated from and connected to one another by attaching means 16 comprising one or a number of discs 16 having apertures 17 in their centers, which attaching means 16 are disposed strategically between the first and second barriers 11 and 12 so as to allow a hermetic cavity 13 defined between the first and second barriers 11 and 12 to extend continuously therebetween. As used herein and in the appended claims, "completely encloses" means that the inner container 12 is completely and continuously encircled about its periphery 12 so that all points surrounding the inner barrier 12 are enveloped by at least one outer barrier 11. A sensor 21 comprising a select chemical or material 21 is inserted within the cavity 13 and a select atmosphere 22 such as a substantially evacuated atmosphere 22 is simultaneously introduced within the cavity 13. The source of the select atmosphere 22 is removed while at the same time sealing the second barrier 11, so that a desired select atmosphere 22 and the sensor 21 are hermetically maintained therein. Means for sealing, such as hermetic sealing, while at the same time maintaining a desired chemical composition, color, texture, or odour of a select chemical 21 or material 21 are known and can be accomplished, for example, in a vacuum chamber where the select chemical 21 or material 21 is in equilibrium with the vacuum so as to be sustaining a desired chemical composition, color, texture, or odour. The barriers 11 and 12 must be so substantially impervious that the sensor 21 and the select atmosphere 22 enclosed within the cavity 13 will be substantially maintained for at least the shelf life of the articles 18 enclosed within the first "complete" barrier. At least one barrier includes sealingly associated cap 12,20 and body 20 portions being provided with one or more intermediate points or lines of weakness 23 which will fracture upon the application of pressure. The cap 12,20 and body 20 portions of the invention are provided with recloseable closure means 24 which, as illustrated by reference to FIG. 3 by way of example, may be removably engaged by rotation. Means for recloseable closures are known and may alternatively include the portions 12,20 and 20 being adapted to be removably and threadedly engaged by rotation to one another 12 and 12,20, as a further example. The sensor 21 and the select atmosphere 22 enclosed within the cavity 13 co-operatively comprise a package integrity indicating sensor system 21 and 22 where the sensor 21 is simulaneously reactive to normal atmosphere air 19 and reversibly responsive to the presence or absence of the select atmosphere 22, so that the sensor 21 sustains a first chemical composition, color, texture, or odour when in equilibrium with normal atmosphere air 19, and a second chemical composition, color, texture or odour when in equilibrium with the select atmosphere 22. The select atmosphere 22 must be sufficient to sustain the sensor 21 in its second chemical composition, color, texture, or odour during hermetic sealed assembly. A breach in package integrity will result in a loss of the select atmosphere 22 and in exposure of the sensor 21 to the normal atmosphere air 19 enclosed within the inner container 12 and/or to the exterior atmosphere, whereby a chemical or physical response will occur such that the sensor 21 will revert to its first chemical composition, color, texture, or odour, thereby producing an indication appealing to the sense of sight, touch, or smell at the point of puncture, or within the cavity 13 that could evidence a package 11 tampering.

Although the present invention has been shown and described herein with reference to specific embodiments thereof comprising inner and outer barriers made of a substantially impervious plastic material, it should be evident that any number of multiple barriers could be so used within the scope of this disclosure, and that the materials of construction of this invention could be of any substantially impervious material, or of any substantially gas or air impermeable material suitable for the objects detailed herein, and it should be understood that the thickness, flexibility, configuration, translucence, and color of the barriers may vary in alternative embodiments of the present invention, and that one or more cavities can exist therebetween.

Figure 5:
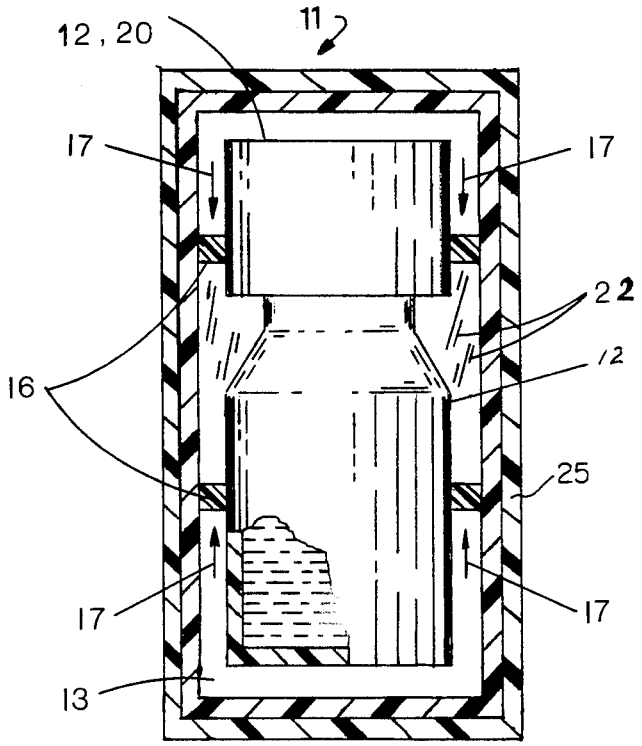
FIG. 5 is a cross-sectional view of an alternative embodiment of the cylindrical container shown in FIG. 1, illustrating the inner container of the present invention being filled with a liquid or a gel, and shows an additional barrier completely enclosing the second barrier of the invention.

The sensor 21 can be indicia means 21 being impregnated on a carrier 21 such as a mat and the like, or alternatively, the sensor 21 can be incorporated into an ink, which ink is printed or stamped on the carrier 21 which is thereafter sealed within the cavity 13, which cavity walls 11 and 12 are transparent, translucent, or of a color such that the indicia means 21 are visible from the exterior of the package 11, or similarly, the indicia means 21 can be printed or stamped or the like, on a strip of paper 21 and thereafter inserted within the cavity 13. Alternatively, the cavity walls 11 and 12 can be transparent, translucent, or of a color allowing visibility from the exterior of the package 11, and the sensor 21 can be coated, printed, or stamped or the like, on an inner surface of the package 11 so as to be visible from the exterior of the package 11. The fracturable point or lines of weakness 23 sealingly associating the cap 12,20 and body 20 portions of the package 11 are shown in FIG.1 as a broken line encircling the package 11 during hermetic sealed assembly. FIG. 2 shows a cross-sectional view of the package 11 illustrated in FIG. 1 during hermetic sealed assembly, illustrating the components of construction of the package 11 including: the cavity 13 encasing the first container 12 being indicated as a partially obstructed blank defined between the first and second barriers 11 and 12; the select atmosphere 22 enclosed between the cavity walls 11 and 12 is indicated by inclined lines 22 illustrated between the cavity walls 11 and 12, and; the normal atmosphere air 19 enclosed within the inner container 12 is indicated by small particles 19 revealed by the broken-away portion of the container 12. The cap 12,20 and body 12 portions of the package 11 illustrated in FIG. 1 are shown separated from one another in FIG. 3 to reveal the opening 15 of the inner container 12 and the hermetic sealing means 14 being bonded thereon, the irregular broken lines revealed by the broken-away portion of the inner container 12 illustrate the inner container 12 being filled with a liquid or a gel. The cap portion 12, 20 of the package illustrated in FIG. 1 is shown in FIG. 4 illustrating the attaching means 16 having appertures 17 in their centers being disposed between the inner and outer containers 11 and 12 while simultaneously separating and connecting the inner and outer container walls 11 and 12. FIG. 2 shows the package illustrated in FIG. 1 with a printed sensor affixed to the outer surface of the container 12. FIG. 5 shows an alternative embodiment of the package 11 illustrated in FIG. 1, and shows an additional barrier 25 completely enclosing the second barrier 11, the irregular broken lines 18 revealed by the broken-away portion of the inner container 12 illusrate the inner container 12 being filled with a liquid or a gel 18, and shows an additional barrier 25 completely enclosing the second barrier 11. FIG. 6 shows another embodiment of the package illustrated in FIG.1 showing the sealingly associated cap 12,20 and body 12 portions of the invention during hermetic sealed assembly, which portions 12,20 and 12 being adapted with recloseable closure means 24, and illustrates the attaching means 16 being simultaneously separating and connecting the barrier walls 11, 12, 25, etc., as shown, one or more barriers 25, etc., can be completely enclosing the second barrier 11, and at least one cavity can exist between the innermost and the outermost barriers.

Although we have shown and described embodiments of our invention with a certain degree of particularity, it will be understood that: there are numerous substantially impervious materials and the like, that there are numerous substantially gas or air impermeable materials and the like, that there are numerous mat materials and the like, that there are numerous sensor materials and the like, and that there are numerous select atmospheres and the like, that would be suitable for the construction of the present invention as shown and described hereinabove, and it should be understood that numerous changes in the details of construction and the combination and arrangement of parts may be resorted to without departing from the spirit and the scope of the invention as hereinafter claimed.

We claim:

1. A tamperproof package comprising in combination:

(a) a first container containing a substance and a first atmosphere, and a first cap hermetically sealing the substance and the first atmosphere in the first container;

(b) a second container containing the first container and a second atmosphere and heremetically sealing the first container and the second atmosphere in the second container, there being a cavity between the first and second containers, the cavity complete surrounding the first container;

(c) sensing means in the cavity for undergoing a readily detectable change in response to substantial modification of the second atmosphere due to leakage of gas into or out of the cavity through a rupture in a wall of the first container or the second container, wherein the first and second containers are rigid, and wherein the second atmosphere is of a pressure different than the pressure of the ambient atmosphere outside the second container and the pressure of the first atmosphere.

2. The tamperproof package of claim 1 wherein the second atmosphere has a pressure that is much lower than the pressure of the first atmosphere or ambient atmospheric pressure.

3. The tamperproof package of claim 2 wherein the sensing means includes a printed strip on the first container, a wall of the second container being transparent, the substantial modification of the second atmosphere causing a change in appearance of the sensing means.

4. The tamperproof package of claim 3 wherein the second container includes a line of weakness between a body section and a cover section, whereby twisting of the cover section removes it from the body section, exposing the first cap.

5. The tamperproof package of claim 1 wherein the first and second containers are composed of material so impervious that the second atmosphere is substantially unchanged for at least the shelf life of the tamperproof package and articles unless the wall of the first container or second container is ruptured.

6. The tamperproof package of claim 1 wherein the sensing means includes material from the group consisting of air-sensitive dye, air-sensitive paper, pH sensitive dye.

7. The tamperproof package of claim 5 including means between the first and second containers for supporting the first container in spaced relationship to an interior surface of the second container.

8. A method of making a tamperproof package, comprising the steps of:

(a) providing a first container containing a substance and a first atmosphere, and a first cap, and hermetically sealing the substance and the first atmosphere in the first container;

(b) providing a second container, placing the first container and a second atmosphere in the first container, and hermetically sealing the first container and the second atmosphere in the second container after causing the second atmosphere to be of a pressure different than the pressure of the first atmosphere and different than the pressure of the ambient atmosphere outside of the second container; and (c) providing a sensor in a cavity between the first and second containers for undergoing a readily detectable change in response to substantial modification of the second atmosphere caused by leakage of gas into or out of the cavity through a rupture in a wall of the first container or the second container.

* * * * *